US005518192A

United States Patent [19]

Hamaguchi

[11] Patent Number: 5,518,192

[45] Date of Patent: May 21, 1996

[54] VERTICAL ROLLER MILL

[75] Inventor: Masaki Hamaguchi, Takasago, Japan

[73] Assignee: Kabushiki Kaisha Kobe Seiko Sho, Kobe, Japan

[21] Appl. No.: 212,868

[22] Filed: Mar. 15, 1994

[51] Int. Cl.[6] ..... B02C 15/04

[52] U.S. Cl. ..... 241/121; 241/293

[58] Field of Search ..... 241/120, 121, 241/122, 293

[56] References Cited

U.S. PATENT DOCUMENTS

| | | | |
|---|---|---|---|
| 1,840,366 | 1/1932 | Loesche | 241/121 |
| 4,611,765 | 9/1986 | Shimojima et al. | 241/121 |
| 5,244,157 | 9/1993 | Brundiek | 241/36 |

FOREIGN PATENT DOCUMENTS

| | | | |
|---|---|---|---|
| 561582 | 8/1958 | Canada | 241/121 |
| 0383004 | 8/1990 | European Pat. Off. | 241/293 |
| 3270739 | 12/1991 | Japan | 241/293 |
| 5104010 | 4/1993 | Japan | 241/121 |
| 1230681 | 5/1986 | U.S.S.R. | 241/121 |
| 2162088 | 1/1986 | United Kingdom | 241/121 |

*Primary Examiner*—John Husar

*Attorney, Agent, or Firm*—Oblon, Spivak, McClelland, Maier & Neustadt

[57] ABSTRACT

A vertical roller mill which maintains a predetermined milling capacity for a long period of operation is disclosed. The outer portion of the grinding face of a milling roller is chamfered with respect to a tangent drawn at the point at which chamfering of the grinding surface of the milling roller begins and/or the outer portion of the surface of a table liner is chamfered with respect to a tangent drawn at the point at which chamfering of the surface of the table liner begins. Through this structure, a milled material is smoothly discharged to the outside of the milling table, and an otherwise possible overload to the vertical roller mill is prevented. Further, the wide and shallow abrasion pattern resulting from the use of this structure means the vertical roller mill can maintain a predetermined milling performance for a long period of operation.

20 Claims, 5 Drawing Sheets

VERTICAL ROLLER MILL

BACKGROUND OF THE INVENTION

1. Field of the Invention

This invention relates to improvements in or relating to a vertical roller mill, and more particularly to a vertical roller mill in which the risk of overload occurring during milling of a substance such as cement clinker or blast furnace slag is diminished and whose performance is stable over a long period of time.

2. Description of the Prior Art

Various vertical roller mills are conventionally known, and an example of one of said conventional vertical roller mills, in which the raw material is ground between a table liner mounted on a milling table for rotation about a vertical axis, and milling rollers mounted for rotation about a roller shaft and disposed circumferentially around the axis of rotation of the milling table and designed to be resiliently pressed with a certain force against said table liner, is disclosed in Japanese Examined Patent Publication No. Hei 2-27017 and is of the type shown in FIG. 1. As described in the above Japanese Examined Patent Publication and as shown in FIG. 1, the conventional vertical roller mill is characterized in that the gap (1) formed between the face of the milling roller (2) and that of the table liner (3) of the milling table (4) has a wedge-like sectional shape which decreases in sectional area as one moves towards the circumference of the milling table such that the outlet gap (5) has the minimum sectional area.

However the wear upon the table liner of the milling table and the milling roller is not uniform along the grinding faces of the table liner and the milling rollers and it is observed that relatively little wear occurs at the very outer portions of the grinding face of the milling rollers (i.e. those portions of the grinding faces adjacent the outer side (8) of the milling roller) and corresponding portions of the table liner and as a result these areas become protruded relative to areas located further towards the axis of rotation of the milling table which are subject to severe wear. These protruded areas prevent the smooth discharge of the milled product to the outside of the milling table with the consequent risk of overload occurring. They also prevent much of the grinding aces of the milling rollers and table liner from coming together sufficiently closely for optimum grinding.

There is the possibility that these protruded areas will break off and that as a consequence the risk of overload will diminish as the milled product is once again able to be discharged smoothly to the outside of the milling table and that the grinding efficiency will increase towards its optimum value as the grinding surfaces are able to come closer together again. However a significant time may lapse before such breakage occurs, if it occurs at all, and during this time the grinding efficiency is reduced. Furthermore when the edges do break significant vibrations are produced as a result and said vibrations are harmful to the mill and in the worst case may cause the mill to stop. For these reasons the formation of these protruded areas is not desirable.

For the conventional vertical roller mill, in order to avoid overload, the countermeasure of reducing the supply of feed material to the mill was adopted. However, this results not only in a further reduction of the milling efficiency but also results in an artificial reduction in the thickness of the layer of grinding material between the milling rollers and the table liner, and this results in an increase in the the level of harmful vibrations.

SUMMARY OF THE INVENTION

It is an object of the present invention to provide an improved vertical roller mill in which formation of protruding areas at the outer portions of the faces of the milling rollers and/or table liner is avoided, thereby ensuring the smooth discharge of the milled product to the outside of the milling table and ensuring a desirable grinding efficiency and stability of operation throughout a long time period of operation.

In order to attain the objects described above, according to an aspect of the present invention, there is provided a vertical roller mill, which comprises a milling table mounted for rotation around a vertical axis, an annular table liner mounted on said milling table, and milling rollers, supported for rocking motion toward and away from the table liner and for rotation around a roller shaft and adapted to be pressed against said table liner, and wherein the section of the gap formed between the surface of the milling rollers and the surface of the table liner of minimum sectional area is not the section at the outlet gap, as in the conventional roller mill, but is a section located a short distance from the outlet gap towards the axis of rotation of the milling table.

This may be achieved by chamfering an outermost portion of the milling roller (i.e the portion of the grinding face adjacent to the outer side of the milling roller) of the conventional vertical roller mill. A suitable width for the chamfered portion may be determined by studying the wear pattern of the grinding faces of the milling roller and table liner of a conventional roller mill.

The object of this invention may also be achieved by chamfering the outer portion of the table liner of a conventional vertical roller mill or by chamfering the outer portions of both the table liner and the milling roller of a conventional vertical roller mill.

By using milling rollers and/or table liners incorporating the feature of this invention, a wide and shallow shape is maintained even after abrasion. In this way a high milling efficiency can be maintained and the smooth discharge of milled product to the outside of the milling table is ensured thus preventing overload of the roller mill. Thus through this invention it is no longer necessary to reduce the supply of feed material to the vertical roller mill thereby ensuring a good milling efficiency, as well as maintaining a good thickness of layer of grinding material between the milling rollers and the table liner thereby avoiding the increase in generation of harmful vibrations.

The above and other objects, features and advantages of the present invention will become apparent from the following description and the appended claims, taken in conjunction with the accompanying drawings in which like parts or elements are denoted by like characters.

DETAILED DESCRIPTION OF THE PREFERRED EMBODIMENTS

As described above, this invention concerns the improvement in a vertical roller mill of chamfering the outermost portion of the grinding face of the milling roller and/or the outermost portion of the grinding surface of the table liner of the conventional roller mill. It is to be noted that suitable widths for the chamfered portions will be dependent on the size of the milling roller and table liner and on the type of grinding material. Suitable widths may be determined by studying the abrasion patterns of the conventional vertical roller mill.

It has been confirmed that in the case of the milling roller, it is preferred that the chamfering angle be between 25° and 30°. When the chamfering angle is smaller than 25°, the table liner 23 applies an unnecessary pressure to the outermost portion of the milling roller 25. When the chamfering angle is greater than 30°, the grinding material is discharged at an excessive rate from the milling table with the result that the roller mill does not operate effectively.

It has also been confirmed that in the case of the table liner, it is preferred that the chamfering angle be about 15°.

Figure 1:
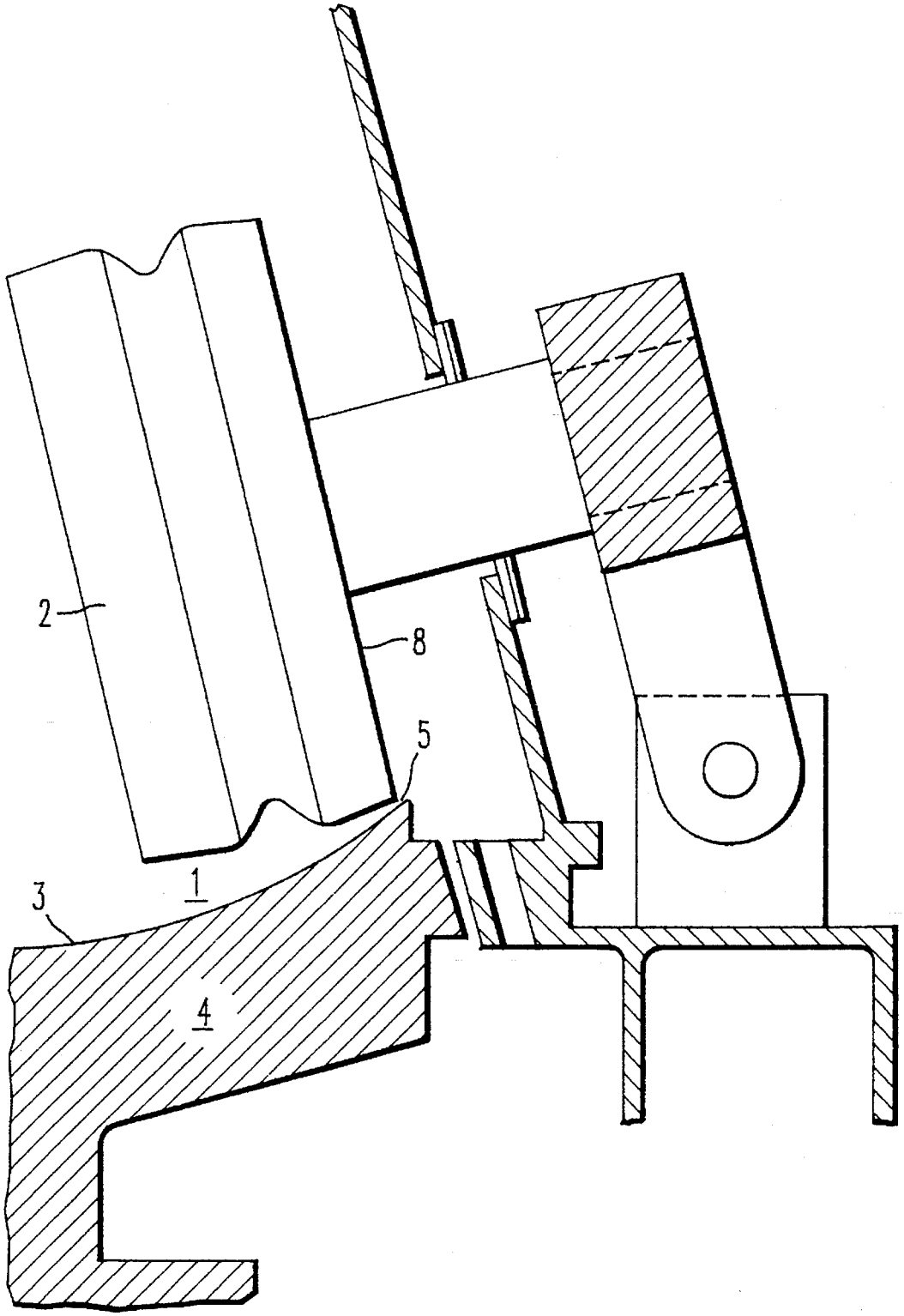
FIG. 1 PRIOR ART
FIG. 1 is a front elevational view, partly in section, of a part of a conventional vertical roller mill.
Figure 2:
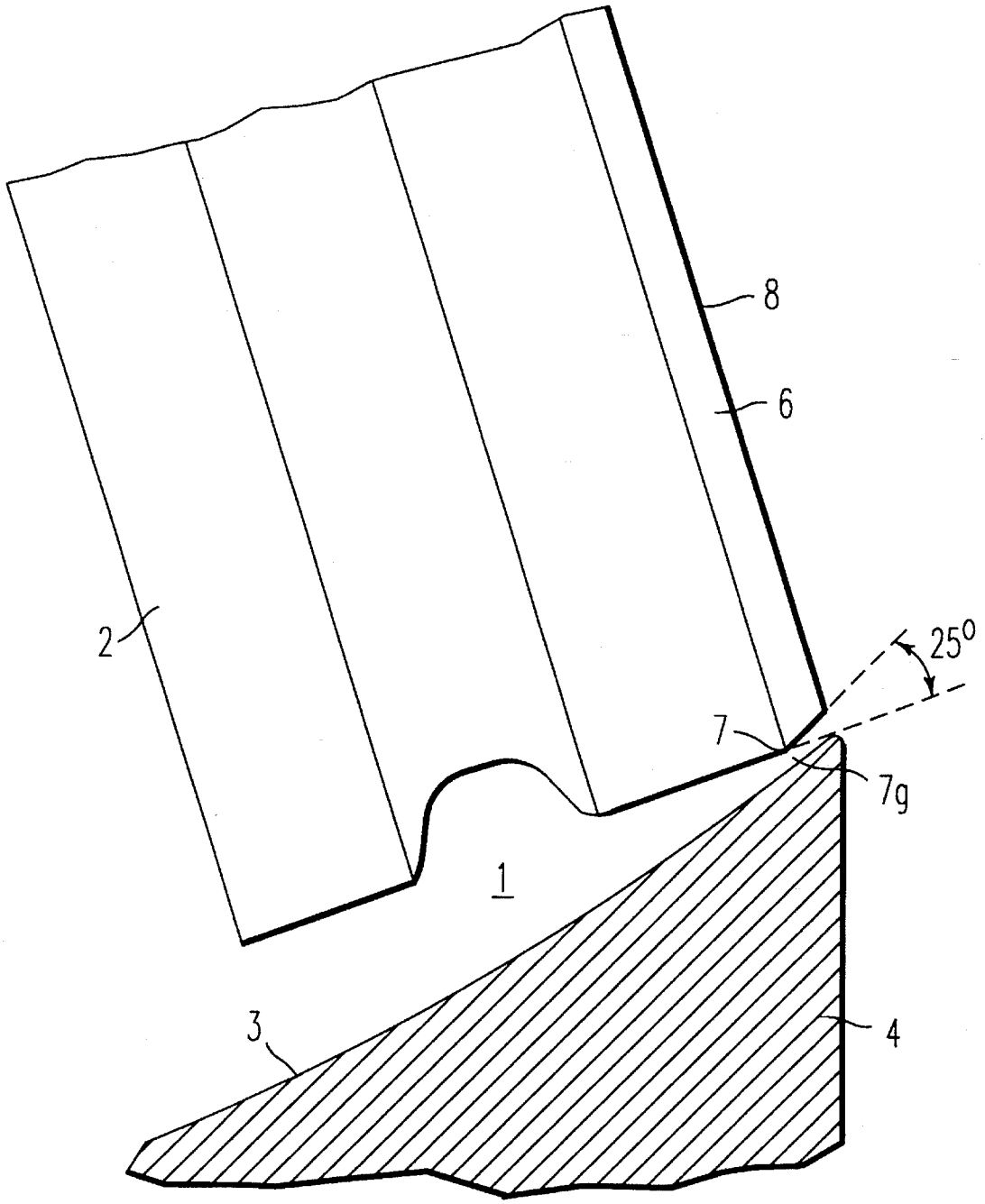
FIG. 2 is a schematic side elevational view of a part of a vertical roller mill showing a first preferred embodiment of the present invention.

Next, with reference to FIG. 2, a first preferred embodiment of the present invention will be described. FIG. 2 is a schematic side sectional view of part of a vertical roller mill showing a first preferred embodiment of the present invention. As in the above embodiment, the feed material is ground between a table liner (3) mounted on a milling table (4) rotating about a vertical axis, and milling rollers (2) mounted for rotation about a roller shaft and disposed circumferentially around the axis of rotation of the milling table and designed to be resiliently pressed with a certain force against said table liner. The table liner has a sloped face such that the grinding surface of the table liner increases in height as one moves towards the circumference of the milling table. The milling roller is disposed such that the grinding face of the milling roller is at an angle to the surface of the table liner. In the above respect it is similar to the conventional roller mill. However, as shown in FIG. 2, it differs from the conventional vertical roller mill in that the outer portion (6) of the grinding face of the milling roller (i.e. the portion of the grinding face adjacent to the outer side (8) of the milling roller) has been chamfered at an angle of 25° with respect to an imaginary tangent drawn at the point (7) at which chamfering of the grinding surface of the milling roller begins. As shown in FIG. 2, a minimum gap (e.g. as shown at 7*g*) can thus be disposed at a location spaced from the outermost end 8 of the milling roller.

It should be noted that this invention can be applied to vertical roller mills of any sizes. However in order to demonstrate the effect of this invention, a vertical roller mill of a particular size and showing the first preferred embodiment of the present invention shall be described with reference to FIG. 3. As in the FIG. 2 embodiment, the gap thickness increases at an outermost side 8 of the milling roller such that a minimum gap thickness is disposed inwardly therefrom as shown, e.g., at 7*g*.

Figure 3:
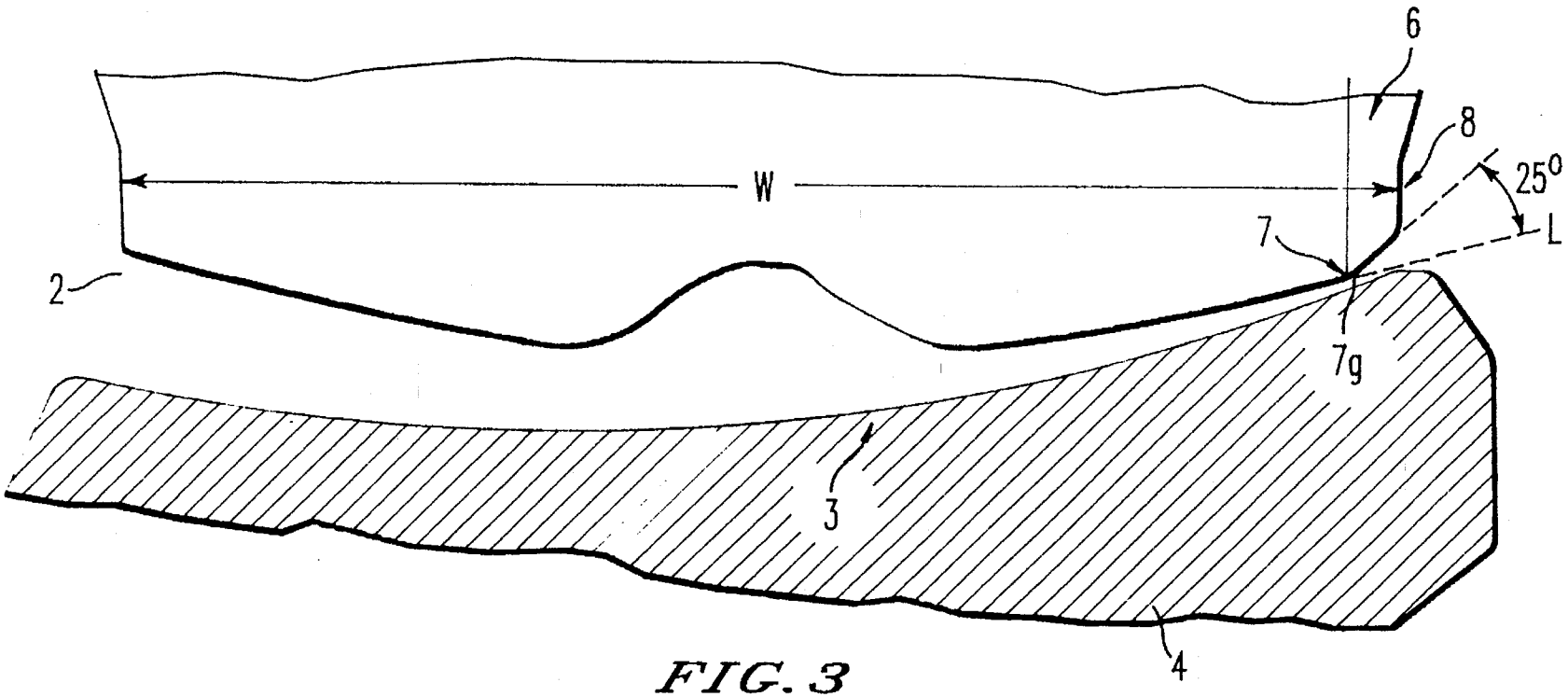
FIG. 3 is a diagram of a cross-sectional view of the gap between one of the milling rollers and the table liner of a vertical roller mill showing a first preferred embodiment of the present invention.

FIG. 3 is a diagram of a cross-sectional view of the gap between one of the milling rollers (2) and the table liner (3) of a vertical roller mill showing the first preferred embodiment of the present invention. FIG. 3 only shows one of the milling rollers disposed circumferentially around the axis of rotation of the pulverizing table but all the milling rollers of the vertical roller mill have this shape. The grinding surface of the milling roller (2) shown in FIG. 3 has a width, W, of about 900 mm and by observing the wear patterns of the conventional vertical roller mill of that size it was determined that the width of the chamfered portion should be about 40 mm, approximately, 4% of the width of the grinding face of the milling roller.

Figure 4:
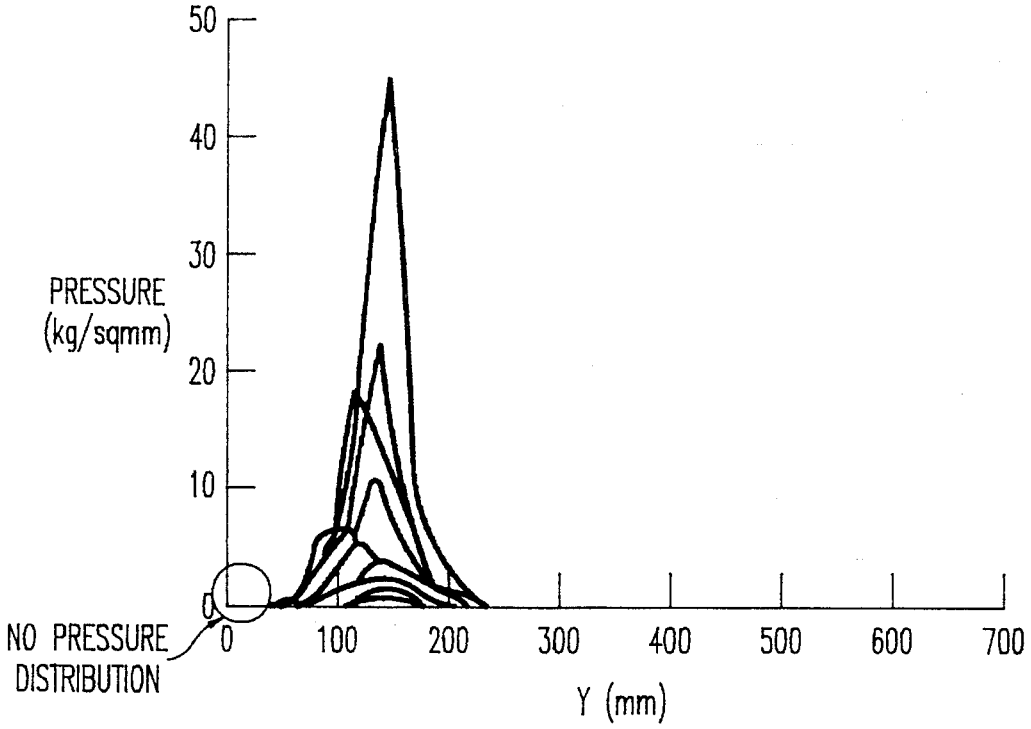
FIG. 4 is a chart showing the pressure distribution for the vertical roller mill of FIG. 3
Figure 5:
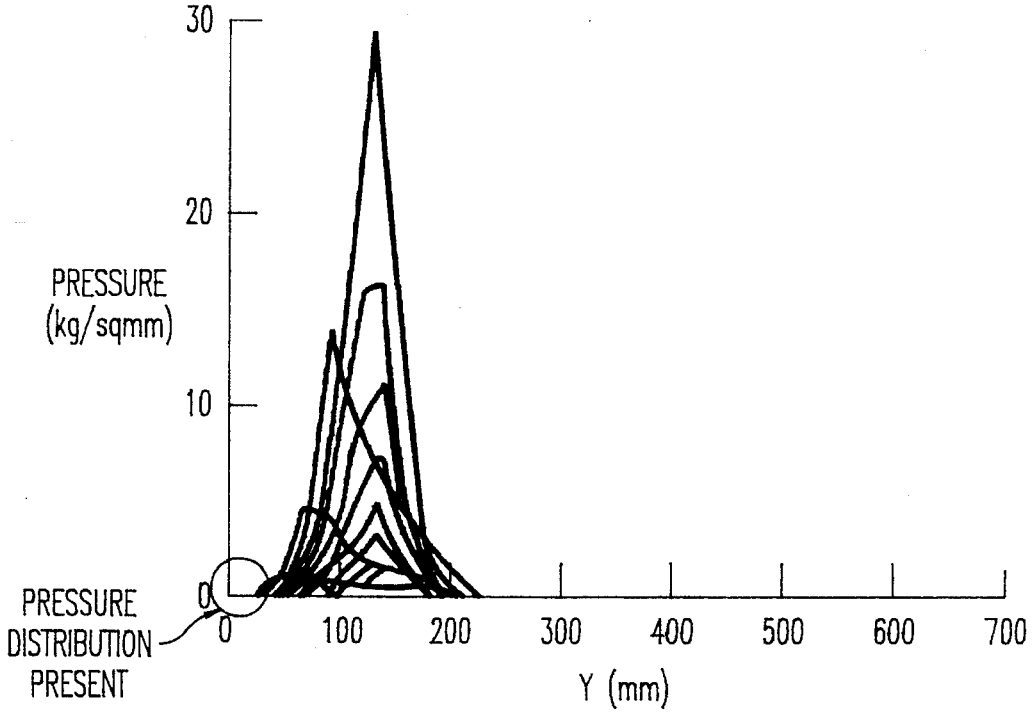
FIG. 5 is a chart showing the pressure distribution for a conventional vertical roller mill of the same size as the vertical roller mill of FIG. 3

A pressure distribution diagram, obtained by calculation based on a powder compression theory, for this vertical roller mill is shown in FIG. 4. In FIG. 4, the ordinate axis represents the pressure (kgf/mm$^2$) and the abscissa represents the distance Y(mm) along the grinding surface of the milling roller from the outer side (8) of the milling roller toward the center of rotation of the milling table. It is useful to compare this diagram with the pressure distribution diagram, as shown in FIG. 5, for the conventional roller mill of identical size and construction but which has not been chamfered. The circle represents the portion corresponding to the portion of the grinding face of the milling roller 25 within 40 mm of the outer side of the milling roller. As can be seen by comparing FIGS. 4 and 5, there is a pressure distribution present in this 40 mm region for the conventional roller mill, but for the vertical roller mill according to the present invention, no pressure distribution is observed in this 40 mm region. This is manifested in operation of the vertical roller mill according to the present invention by the fact that the milled product is discharged smoothly to the outside of the milling table. Furthermore, with the vertical roller mill according to the present invention, the excessively protruding areas that were observed for the conventional vertical roller mill and which effected the efficiency of the mill and whose breakage generated harmful vibrations, are not observed for the vertical roller mill according to the present invention and as a result, stability of operation and a good milling efficiency can be maintained for a long period of time, without the need to reduce the supply of feed material to the mill for fear of overload.

Figure 6:
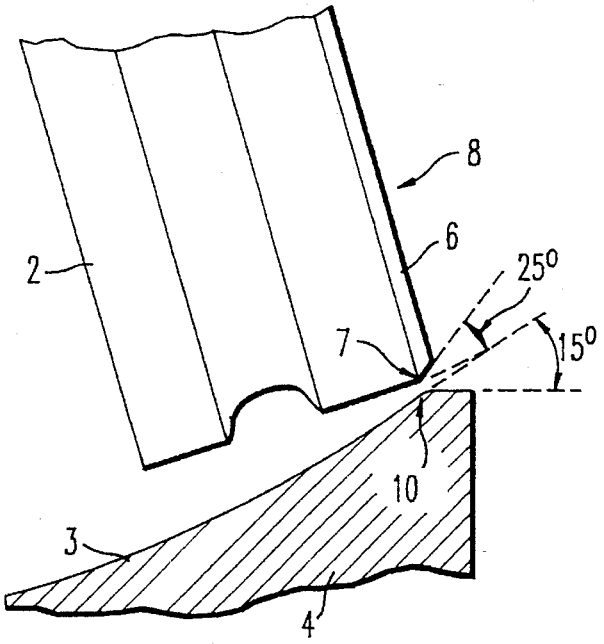
FIG. 6 is a schematic side elevational view of part of a vertical roller mill showing a second preferred embodiment of the present invention.

Next, with reference to FIG. 6, a second preferred embodiment of the present invention will be described. FIG. 6 is a schematic side sectional view of part of a vertical roller mill showing a second preferred embodiment of the present invention. As in the above embodiment, the feed material is ground between a table liner (3) mounted on a milling table (4) rotating about a vertical axis, and milling rollers (2) mounted for rotation about a roller shaft and disposed circumferentially around the axis of rotation of the milling table and designed to be resiliently pressed with a certain force against said table liner. The table liner has a sloped face such that the surface of the table liner increases in height as one moves towards the circumference of the milling table. The milling rollers are disposed such that the grinding face of the milling roller is at an angle to the surface of the table liner. In the above respect it is similar to the conventional roller mill. However, as shown in FIG. 6, it differs from the conventional vertical roller mill in that the outer portion of the grinding face of the milling roller (i.e. the portion of the grinding face adjacent the outer side (8) of the milling roller) has been chamfered at an angle of 25° with respect to an imaginary tangent drawn at the point (7)

at which chamfering of the milling roller begins, and the outer portion of the table liner has been chamfered at an angle of 15° with respect to an imaginary tangent drawn at the point (10) at which chamfering of the table liner begins. As mentioned above suitable widths for the chamfered portions will be dependent on the size of the milling roller and table liner and on the type of grinding material, but may be determined by studying the abrasion patterns of the conventional vertical roller mill.

Figure 7:
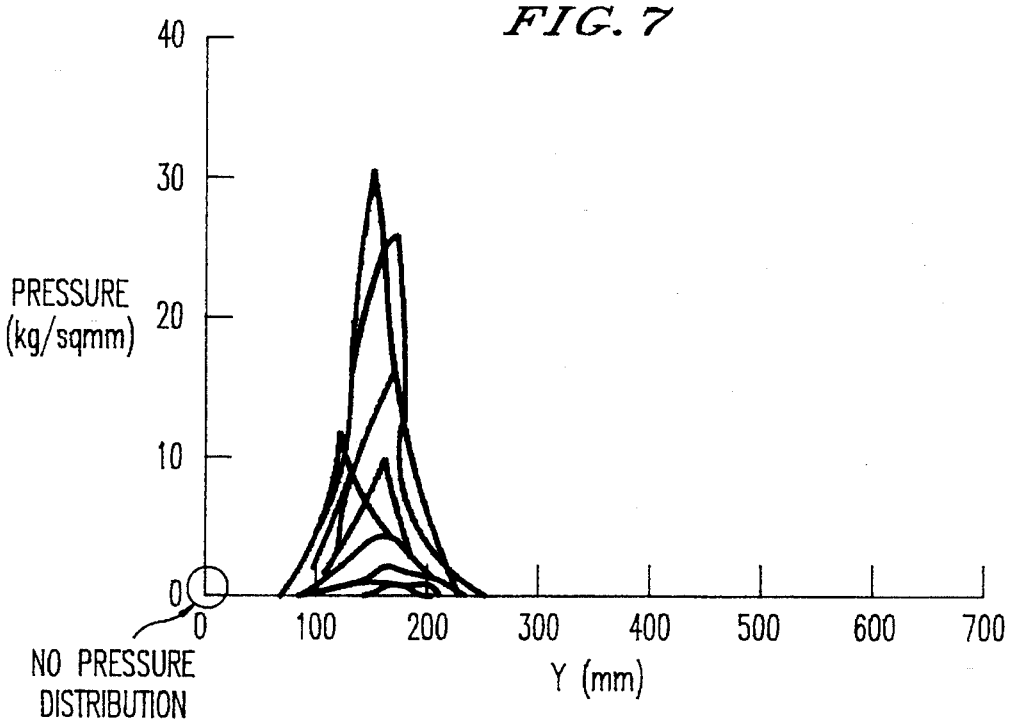
FIG. 7 is a chart showing the pressure distribution for the vertical roller mill showing a second preferred embodiment of the present invention.

FIG. 7 shows the pressure distribution diagram for the vertical roller mill of the size and construction described in the first preferred embodiment for which both the outer portions of the table liner and milling roller have been chamfered in accordance with the second preferred embodiment of the present invention. As can be seen in FIG. 7, the effect is similar to that observed for the first preferred embodiment, in that no pressure distribution is observed in the 40 mm region. This is manifested in actual operation in the same ways as for the first preferred embodiment.

In the embodiments described above, surface working is applied such that, as viewed in a side sectional view, the chamfered portions have a straight line in the radial direction. However, it should be noted that similar effects to those of the above described embodiments can be anticipated if the chamfered portions have gently sloping faces of a large radius of curvature.

Having now fully described the invention, it will be apparent to one skilled in the art that many changes and modifications can be made thereto without departing from the spirit and scope of the present invention as set forth herein.

What is claimed is:

1. A vertical roller mill, comprising:

a milling table mounted for rotation around a vertical axis;

a table liner mounted on said milling table and having a sloping surface;

a milling roller supported for rocking motion toward and away from said table liner and for rotation around an axis;

and wherein an outer portion of a grinding face of said milling roller is chamfered such that a minimum gap between said milling roller and said table liner is disposed at a location spaced from an outermost end of the outer portion of said milling roller.

2. The vertical roller mill according to claim 1 wherein said outer portion of the grinding face of said milling roller is chamfered at an angle of 25–30 degrees.

3. The vertical roller mill according to claim 2 wherein the width of said chamfered outer portion of the grinding face corresponds to about 4% of the width of the grinding face of said milling roller.

4. The vertical roller mill according to claim 1 wherein the outer portion of said table liner is chamfered.

5. The vertical roller mill according to claim 4 wherein said chamfered outer portion of said table liner is chamfered at an angle of about 15 degrees.

6. A vertical roller mill, comprising:

a milling table mounted for rotation around a vertical axis;

a table liner mounted on said milling table and having a sloping surface;

a milling roller supported for rocking motion toward and away from said table liner and for rotation around an axis;

wherein an outer portion of said table liner is chamfered at an angle of about 15°, and a minimum gap between said milling roller and said table liner is disposed at a location spaced from an outermost end of a grinding face of said milling roller.

7. A vertical roller mill, comprising:

a milling table mounted for rotation around a vertical axis;

a table liner mounted on said milling table and having a sloping surface;

a milling roller supported for rocking motion toward and away from said table liner and for rotation around an axis;

said vertical roller mill including at least one of: (1) a chamfered portion at an outer portion of a grinding face of the milling roller; and (2) an outer portion of said table liner which is chamfered with at least part of said outer portion of said table liner which is chamfered opposing a grinding face of said milling roller;

wherein a gap is provided between said milling roller and said table liner, said gap having a minimum thickness at a location spaced from an outermost end of the grinding face of said milling roller, and wherein a thickness of said gap increases from said minimum thickness toward said outermost end of said milling roller.

8. The vertical roller mill of claim 7, wherein said milling roller includes a chamfered portion extending from said outermost end to said minimum gap thickness location.

9. The vertical roller mill of claim 8, wherein said chamfered portion extends a distance which is approximately 4% of a width of a grinding face of the milling roller.

10. The vertical roller mill of claim 9, wherein said chamfered portion is chamfered at an angle of 25–30 degrees.

11. The vertical roller mill of claim 7, wherein said liner includes a chamfered outer portion.

12. The vertical roller mill of claim 11, wherein said chamfered outer portion of said liner is chamfered at an angle of approximately 15 degrees with respect to an adjacent portion of said liner which is immediately adjacent to said chamfered portion.

13. A vertical roller mill, comprising:

a milling table mounted for rotation around a vertical axis;

a table liner mounted on said milling table and having a sloping surface;

a milling roller supported for rocking motion toward and away from said table liner and for rotation around an axis;

wherein a gap is provided between said milling roller and said table liner, said gap having a minimum thickness at a location spaced from an outermost end of a grinding face of said milling roller, and wherein a thickness of said gap increases from said minimum thickness toward said outermost end of said milling roller;

wherein said milling roller includes a chamfered portion extending from said outermost end, and wherein said table liner includes a chamfered outer portion.

14. The vertical roller mill of claim 13, wherein said chamfered portion of said milling roller is chamfered at an angle of 25–30 degrees and said chamfered outer portion of said liner is chamfered at an angle of approximately 15 degrees with respect to an adjacent portion of said liner which is immediately adjacent to said chamfered portion.

15. The vertical roller mill of claims 13 or 14, wherein said chamfered portion of said milling roller extends from said outermost end a distance which is approximately 4% of the width of the milling roller.

16. A vertical roller mill, comprising:

a milling table mounted for rotation around a vertical axis;

a table liner mounted on said milling table and having a sloping surface;

a milling roller supported for rocking motion toward and away from said table liner and for rotation around an axis;

wherein an outer portion of a grinding face of said milling roller is chamfered at an angle of 25–30 degrees.

17. The vertical roller mill of claim 16, wherein said chamfered outer portion corresponds to approximately 4% of the grinding face of said milling roller.

18. A vertical roller mill, comprising:

a milling table mounted for rotation around a vertical axis;

a table liner mounted on said milling table and having a sloping surface;

a milling roller supported for rocking motion toward and away from said table liner and for rotation around an axis;

wherein an outer portion of said table liner is chamfered at an angle of approximately 15 degrees with respect to an adjacent portion of said liner which is immediately adjacent to the chamfered portion.

19. The vertical roller mill of claim 18, wherein an outer portion of a grinding face of said milling roller is chamfered at an angle of 25–30 degrees.

20. The vertical roller mill of claim 19, wherein said chamfered outer portion of said milling roller corresponds to approximately 4% of the grinding face of said milling roller.

* * * * *